United States Patent [19]

Lee

[11] 4,249,743

[45] Feb. 10, 1981

[54] EXPENDABLE, RAPIDLY REPLACED, SINGLE-PART, KNOCK-OVER, PULL CORD CONTROLLED TARGET ELEMENT

[75] Inventor: Robert W. Lee, Hialeah, Fla.

[73] Assignee: Action Target Products, Inc., Hialeah, Fla.

[21] Appl. No.: 930,344

[22] Filed: Aug. 2, 1978

Related U.S. Application Data

[63] Continuation-in-part of Ser. No. 784,356, Apr. 4, 1977, abandoned.

[51] Int. Cl.[3] ..... F41J 7/04

[52] U.S. Cl. ..... 273/391; 273/408

[58] Field of Search ..... 273/102 AP, 102 R, 102 S, 273/105.2, 105.6, 127 D, 127 R, 391, 392, 408

[56] References Cited

U.S. PATENT DOCUMENTS

| | | | |
|---|---|---|---|
| 157,335 | 12/1874 | Lyon | 273/102 AP |
| 1,125,306 | 1/1915 | Graybill | 273/102 AP |
| 1,638,282 | 8/1927 | Wood | 24/130 |
| 1,657,931 | 1/1928 | Krantz | 273/105.6 |
| 1,681,693 | 8/1928 | Becker | 273/105.6 |
| 1,831,289 | 11/1931 | Dally | 273/105.6 |
| 2,587,042 | 2/1952 | Haiselup | 273/127 R |
| 3,392,980 | 7/1968 | Ortega | 273/105.6 |
| 3,682,478 | 8/1972 | Knight | 273/102 S |
| 3,695,610 | 10/1972 | Thompson | 273/102 AP |

FOREIGN PATENT DOCUMENTS

| | | | |
|---|---|---|---|
| 72787 | 5/1893 | Fed. Rep. of Germany | 273/102 AP |
| 693501 | 6/1940 | Fed. Rep. of Germany | 273/102 R |
| 941470 | 4/1956 | Fed. Rep. of Germany | 273/127 R |
| F 13747 | 4/1956 | Fed. Rep. of Germany | 273/127 R |
| 27237 | of 1904 | United Kingdom | 273/105.2 |
| 25616 | of 1913 | United Kingdom | 273/105.2 |
| 635181 | 4/1950 | United Kingdom | 273/102 R |

*Primary Examiner*—Anton O. Oechsle

[57] ABSTRACT

A penetrable target element that is knocked over by a bullet, and is re-set to a standing position by a pull cord that is quickly attached and detached from the target element. After its mutilation by repeated gunfire, the target, with its removably attached pull cord is quickly and easily detached from a stationary part of a base, and an unused replacement target is quickly attached in its place. The replaceable target element contains both the pivot and pull cord connector devices within its single-part structure, and is stabilized and stands, otherwise unaided, on its bottom marginal edge.

5 Claims, 4 Drawing Figures

EXPENDABLE, RAPIDLY REPLACED, SINGLE-PART, KNOCK-OVER, PULL CORD CONTROLLED TARGET ELEMENT

CROSS REFERENCE TO RELATED APPLICATIONS

This application is a continuation in part of my application Ser. No. 784,356 filed on Apr. 4, 1977, which is hereby abandoned. That abandoned application was a continuation in part of what is now U.S. Pat. No. 4,040,624 entitled "Pull Cord Righting Portable Target."

BACKGROUND OF THE INVENTION

1. Field of the Invention

This invention relates to the target art and more specifically to a pivotable or knock-down pull cord controlled target element that can be used both indoors and outdoors. A target element with these characteristics requires a stabilizing support, a pivoting device, a pull cord attachment device, and must be fabricated from a bullet-penetrable material so that a bullet trap can be used to intercept and arrest the bullet after it has penetrated and transited the target. In order to be practical, the target element must be quickly and easily replaced when mutilated by bullets. To be economical, it should contain but a single part.

2. Description of Prior Art

There has long been a need for a practical target that has the aforementioned characteristics. Prior art pivotable targets are either clamped into and held by a pivotable target holder, or contain additional components that pivotally, but permanently, attach them to a base. Those that do not use target holders resort to using feet or weights on the targets to hold them upright. The pivotable target holders of these devices are a permanent part of the target structure, and serve to both hold the target upright before projectile impact, and to allow the target to fall after projectile impact. A major problem involved with such a holder, however, is that it is not easily and quickly replaced even though it is often the accidental recipient of a bullet that is intended for the target. Another major problem of the pivotable target holder for its' relative weight. In an extremely light weight target that can be penetrated by a low velocity air gun, for instance, the target holder contributes so much weight to the attached target element that the bullet often merely transits the easily penetrable target without knocking it down. Prior art pull cords are permanently connected to the target elements or target holders by the use of additional components such as "eyes" or "arms". The pull cord is fastened to the target or target holder by a permanent connection—not quickly and easily connected or disconnected as with the present invention. The present invention has eliminated the aforementioned problems by eliminating such prior art components as pivotable target holders, weights, feet, and additional pull cord connectors. This also eliminates the danger of mutilating these difficult to replace components.

SUMMARY OF THE INVENTION

In a penetrable, knock-over target element that is raised by a pull cord from the shooters location, the present invention introduces, in the target elements' single-part, both a target element attachment means for quickly, pivotally, and removably attaching the target element to a stationary part of a base, and a pull cord attachment means for quickly, easily, and removably attaching the pull cord to the target element. This facilitates the substitution of an unused target element after the other has been mutilated by repeated gunfire. Both of these quick-attach/detach connections may be accomplished in just a few seconds. The present invention also contains a means of stabilizing the single-part target element so that it stands, otherwise unaided, on its bottom marginal edge without resorting to using feet, weights, or holding devices to hold it upright before bullet impact. The single-part target element is preferably fabricated from a flat piece of material that is capable of being penetrated by even a low velocity bullet. This material may be cardboard, or a plastic such as polyethylene. The quick-attach/detach connector devices of the target element and the pull cord are contained in, or within, the area defined by the boundary of the material substance of the single-part target element without resorting to the use of additional components such as pivotable target holders or pivot elbow arms, pull cord connector eyes or arms, or stabilizing feet or weights.

The target element of the present invention can be very economically manufactured because, in the preferred embodiment, only a simple bend in a portion of its' outer edges and the provision of several apertures in its' single-part construction achieve both of the quick-attach/detach capabilities and provide a stabilizing means for holding the target upright before bullet impact.

DESCRIPTION OF THE PREFERRED EMBODIMENTS

Figure 1:
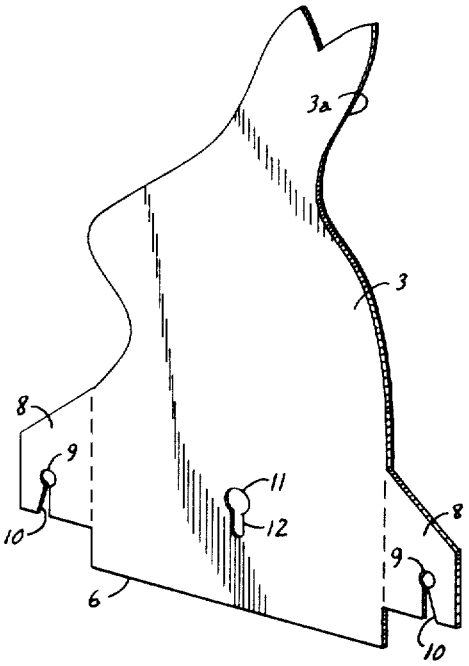
FIG. 1 is a rear perspective view of a silouette type target element prior to the folding back of the tabs or appendages.

An embodiment of the novel target element 2 is in the form of a rectangle that can be relatively small, resulting in a difficult target, or relatively large for an easier or more distant target. In the preferred embodiment, the target element 3 contains a figure means that resembles the sillouette of a wild animal. This will provide a more interesting object to shoot at. The target's front surface 3*a*, naturally, is exposed to the line of projectile travel, and faces the marksman. The basically flat, single-plane target element has, underneath its front surface 3*a*, a bottom marginal edge 6 upon which the target element figure means stands.

A permanent type or non-penetrable version of a target element containing the present invention is constructed from a material that is impervous to an impact from a projectile. Naturally, the material must be strong enough to withstand that impact; the choice of material depending upon what combination of projectile and velocity is being used. This is a practical type target element when shooting outside at relatively long distances where the possibility of a minor bounce-back or uncontrolled ricochet of the projectile off the face of the non-penetrable target element is both unobjectionable and safe. When shooting inside a building or at close distance, however, the target element must be penetrable so that an efficient bullet trapping assemblage or bullet trap can be used in conjunction with it. The bullet trap, when located behind the penetrable target element, will intercept and contain the projectile after the projectile has penetrated and transited the target element, thereby preventing the ricochet problem of a non-penetrable target. Since the target element is penetrated by the projectile, it will eventually be mutilated and in need of replacement. To be a practical target device, the target element and its' attached pull cord must be easily, rapidly, and economically replaced for an unused one. This is one of the basic objects of the present invention; to provide the quick-attach and detach capabilities so that the target replacement can be achieved in just a few seconds. The single part, penetrable target element is fabricated from inexpensive materials such as cardboard or a plastic such as polyethylene, etc. It must have sufficient density and/or thickness to offer some resistance to the passage of a projectile, so that the pivotable and penetrable target element can be toppled to a horizontal position when hit.

The target device contains a stationary pivot rod 5 or spindle that is mounted on the base 1 at a point higher than the floor of the base, and transverse to the line of projectile travel. This location of the pivot rod 5 is also considerably behind the target element 3. The target element is removably and pivotally mounted to the stationary pivot rod 5 in a manner later described.

The target element contains an appendage or tab 8 that extends rearward. It extends from a point on the target elements' rear surface that is higher than its' bottom edge, and is the portion of the target element that is removably and pivotally attached to the stationary pivot rod 5. In addition to being an attaching means, the appendage or tab 8 also serves as a target element positioning means that positions the target element on the base means 1 at a point that is substantially forward of the pivot rod 5. Therefore, the standing target's center of gravity, regardless of its weight, is positioned forwardly of the pivotal axis. The target element is thusly stabilized in this position and is able to stand on its bottom marginal edge 6, without the need of feet, weights, springs, or a pivoting target holder. This holds true with both relatively light-weight targets made from cardboard or plastic and relatively heavy weight target elements made from metal. The center of gravity, being forward of the pivotal axis, also assists in pivoting the target element back to a vertical position after it has been knocked over by a projectile.

Since the bottom edge of the appendage of tab 8 of the target element 3 is higher than the bottom edge 6 of the standing target element, there is sufficient clearance between the appendage and the base to allow the unobstructed pivoting of the target element. This distance also introduces a degree of counter balance in the target element, which assists in resetting the target element from a horizontal to a vertical position.

In the preferred embodiment, the appendage or tab 8 is a homogenous rearward extension of the target element. In other words, the appendage is an integral part of the single-part target element, and they possess a uniform composition throughout. When the target element is manufactured from a plastic, for instance, the appendage and target element may be moulded into an integral unit. By using such methods as extrusion, vacuum or pressure forming, or injection moulding, the appendage may take the form of rearward extending tabs 8. The appendage may also take the form of a horizontally oriented rearward projection 7 of the target element 2. In the preferred embodiment, the outer edges of the target element 3, or at least a portion of the edges, are bent or turned rearward. This forms the homogenous appendage or tabs that extend rearward of the target elements' rear surface, while still retaining the single-plane relationship of the target element's top and bottom edges. The target element 3, with at least part of its outer edges bent rearward, resembles a channel shaped, or flattened "U" shaped section, with the arms of the "U" forming the homogenous appendage 8.

Figure 2:
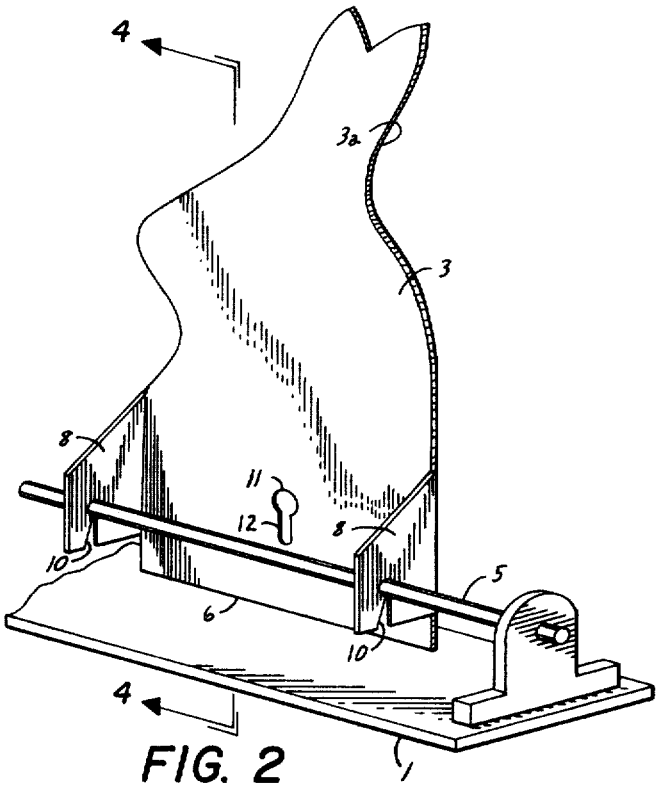
FIG. 2 is a rear perspective view of the target element of FIG. 1 after the tabs have been folded rearward and mounted to the stationary pivot device of the base.

In the preferred embodiment, the pivotable and removable connection between the target element and the pivot rod 5 is accomplished by providing an aperture means near the lower outer edges of the target, as in the rearwardly extending tabs or homogenous monolithic appendage 8 best seen in FIG. 2. The aperture means comprises a substantially circular portion 9 and an opening 10 which extends from the circular portion of the aperture to an edge of the target element or tab 8. The circular portion 9 is slightly larger than the pivot rod 5, so that the target element can pivot around the rod 5. The opening 10 is smaller or narrower than either the circular portion 9 or the pivot rod 5, and serves as a channel leading from an outside edge of the target element or appendage to the circular portion 9. The removable and pivotable connection of the target element and the stationary pivot rod 5 is quickly and easily accomplished by merely pushing the slot opening or channel 10 over and past the pivot rod 5 until the opening 9, at the inner end of the slot 10, encircles and loosely embraces the pivot rod 5. The disconnection of the target element is accomplished by reversing this procedure. Consequently, the quick-attach or quick-detach of the target element and base may be accomplished in just a few seconds.

Figure 3:
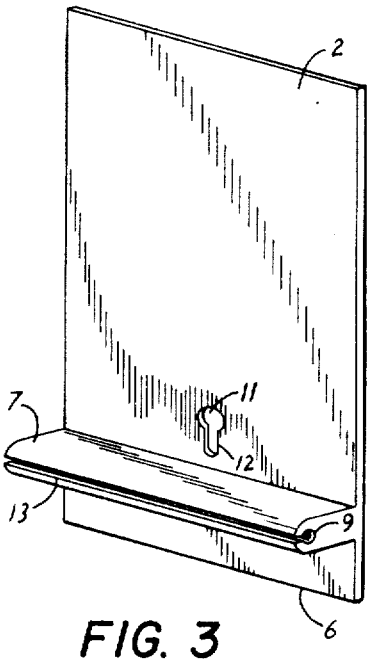
FIG. 3 is a rear perspective view of an alternate embodiment of the target element, fabricated of an extruded material.
Figure 4:
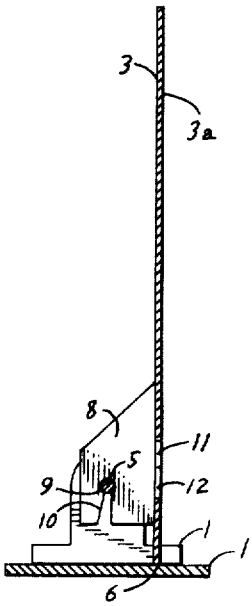
FIG. 4 is a sectional view through the center of the target element of FIG. 2.

Another embodiment of the present invention is shown in FIG. 3. The horizontally oriented homogeneous or monolithic appendage 7 also contains a circular opening 9 and a channel 13 that operates in the same manner as the preferred embodiment previously described.

A quick-attach/detach pull cord-to-target element connection device is also achieved by providing an aperture in the single-part target element shaped, preferably, similar to an old-fashioned keyhole, and consists of a first opening 11 and a smaller or narrower connected second opening 12. The pull cord, not shown in the drawings, contains an enlargement means such as a knot, bead, etc. at the end of the pull cord that connects to the target element. The pull cord enlargement means is smaller than the first opening 11, but larger than the second opening 12. The second opening 12 is substantially the diameter of the pull cord. To achieve the quick pull cord connection, the enlargement means and the end portion of the pull cord are inserted from the front of the target element through the first opening 11 until the enlargement means emerges behind the target element. The end portion of the pull cord is then wedged into the narrow opening 12. The knot or other enlargement means, being too large to be pulled forward through the opening 12, is thusly maintained in juxtaposition with the back of the target element. This provides the easily removable connection of the pull cord and the target element. To remove the pull cord, while preforming a quick-detach target element replacement, the pull cord is lifted up through the snug-fitting second opening 12, and the enlargement means on the end of the pull cord is pulled forward and out through the larger first opening 11.

As the present invention may be embodied in several forms without departing from the spirit or essential characteristics thereof, the present embodiments as herein shown and described are therefore illustrative and not restrictive.

Having described my invention, I claim:

1. A target assembly comprising a base means that contains a pivot rod, a target comprising figure means for exhibiting said target and an attachment means for removably attaching said target to said pivot rod for pivoting said target, the lower edge of said figure means supporting said target on said base in its' upright position, said target being pivotably and removably attached to said pivot rod by said attachment means to enable said figure means to be pivoted from its' upright position to a horizontal position, said attachment means comprising first aperture means for attaching or detaching said attachment means to said pivot rod, said first aperture means comprising a substantially circular portion and an opening, said opening extending from said circular portion at a point where the opening is smaller than said circular portion and said pivot rod whereby said attachment means is removably secured to said pivot rod, a pull cord extending forward of and attached to said target to reset said target from its horizontal to its upright position after being hit, said pull cord being attached in juxtaposition to said target by a second aperture means in said target, said second aperture comprising a first opening and a smaller connected second opening substantially the diameter of said cord, said cord having enlargement means near its end for securing to said target, said enlargement means being smaller than said first opening and larger than said second opening whereby said cord is secured to said target.

2. A target assembly comprising a base, a pivot rod spaced from said base, a one piece cardboard target comprising figure means for exhibiting said target and attachment means for pivoting said target, said attachment means extending in a plane normal to and behind said figure means, the lower edge of said figure means supporting said target on said base in its upright position, said target being pivotably attached to said pivot rod by said attachment means to enable said figure means to be pivoted from its upright position to a horizontal position, said attachment means being spaced substantially above said base to allow unobstructed pivotal movement, said attachment means comprising first aperture means for attaching or detaching said attachment means to said pivot rod, said aperture means comprising a substantially circular portion and an opening, said opening extending from said circular portion at a point where the opening is smaller than said circular portion and said pivot rod whereby said attachment means is secured to said pivot rod, a pull cord extending forward of and attached to said target to reset said target from its horizontal to its' upright position after being hit, said pull cord being attached to said target by a second aperture in said target, said second aperture comprising a first opening and a smaller connected second opening below said first opening substantially the diameter of said cord, said cord having enlargement means near its end for securing to said target, said enlargement means being smaller than said first opening and larger than said second opening whereby said cord is secured to said target.

3. A target arrangement comprising a single-part target element pivotally mounted to a base means that contains a stationary pivot device, a pull cord for raising said target element from a prone to an upright position said pull cord having enlargement means near its end, and an improvement provided within the boundary of the material substance of said single-part target element that comprises, in combination:

A. a first aperture means comprising a substantially circular portion and an opening, said opening extending from said circular portion at a point where the opening is smaller than said circular portion and said stationary pivot device and whereby said single part target element is pivotally and quickly attached to and detached from said stationary pivot device and B. a second aperture means comprising a first opening and a smaller connected second opening substantially the diameter of said pull cord, said enlargement means being smaller than said first opening and larger than said second opening, whereby said pull cord and said enlargement means are quickly and removably secured and maintained in juxtaposition to said single-part target element.

4. A target arrangement comprising a single-part target element pivotally mounted to a base means that contains a stationary pivot device, a pull cord for raising said target element from a prone to an upright position said pull cord having enlargement means near its end, and an improvement provided within the boundary of the material substance of said single-part target element that comprises an aperture comprising a first opening and a smaller connected second opening substantially the diameter of said pull cord, said cord having enlargement means near its end for securing to said target, said enlargement means being smaller than said first opening and larger than said second opening whereby said cord is quickly and removably secured in juxtaposition to said single-part target element.

5. A target arrangement comprising a base means that contains a target element stationary pivot device, a single-part target element that is pivotally mounted to said device and pivots to a prone position when hit by a projectile, a pull cord for raising said target element from a prone to a standing position, said cord having an enlargement means near its end, and an improvement in said single-part target element that comprises, in combination:

a. a target element attaching/detaching means contained within the area defined by the boundary of the material substance of said single-part target element for pivotally, quickly, and removably attaching said single-part target element to said stationary pivot device, said means further comprises a first aperture means comprising a substantially circular portion and an opening, said opening extending from said circular portion at a point where the opening is smaller than said circular portion and said stationary pivot device whereby said single-part target element is stabilized and stands, otherwise unaided, on its bottom marginal edge on said base means, and is pivotly and quickly attached and detached from said base means for easy replacement when mutilated by said projectile.

b. a pull cord attaching/detaching means also contained within the area defined by the boundary of the material substance of said single-part target element, said means further comprises a second aperture means comprising a first opening and a smaller connected second opening substantially the diameter of said pull cord, said pull cord enlargement means being smaller than said first opening and larger than said second opening whereby said cord is quickly and removably attached and secured in juxtaposition to said single-part target element.

* * * * *